US006045263A

United States Patent [19]

Keller et al.

[11] Patent Number: 6,045,263

[45] Date of Patent: Apr. 4, 2000

[54] GIFT PACKAGE

[75] Inventors: Janet T. Keller, Eagan; Perry S. Dotterman, Maplewood; Karen F. MacDonald, St. Paul, all of Minn.

[73] Assignee: 3M Innovative Properties Company, Saint Paul, Minn.

[21] Appl. No.: 09/105,322

[22] Filed: Jun. 26, 1998

[51] Int. Cl.[7] ..... B65D 33/16

[52] U.S. Cl. ..... 383/33; 141/390; 248/99; 383/96

[58] Field of Search ..... 383/33, 95, 96; 141/390; 248/95, 99; 229/116.5, 87.19, 923; 428/12

[56] References Cited

U.S. PATENT DOCUMENTS

| | | | |
|---|---|---|---|
| D. 305,728 | 1/1990 | Tufariello | D9/305 |
| 392,236 | 11/1888 | Soper | 383/95 |
| 1,463,113 | 7/1923 | Bibb | 383/95 |
| 2,272,938 | 2/1942 | Ferrante | 383/95 |
| 2,505,289 | 4/1950 | Haslett | 383/33 |
| 3,006,532 | 10/1961 | Fine . | |
| 3,145,908 | 8/1964 | Smith | 383/95 |
| 3,268,151 | 8/1966 | Soto | 229/62 |
| 3,905,406 | 9/1975 | Cruse | 141/390 |
| 4,379,797 | 4/1983 | Cole | 428/9 |
| 4,482,116 | 11/1984 | Vadnais | 248/99 |
| 4,749,011 | 6/1988 | Rylander | 383/33 |
| 4,836,690 | 6/1989 | Cheng | 383/6 |
| 4,846,427 | 7/1989 | Jones | 248/95 |
| 4,867,577 | 9/1989 | Cheng | 383/78 |
| 4,930,903 | 6/1990 | Mahoney | 383/6 |
| 5,044,773 | 9/1991 | Harms et al. | 383/22 |
| 5,044,774 | 9/1991 | Bullard et al. | 383/33 |
| 5,165,800 | 11/1992 | Downey | 383/78 |
| 5,184,896 | 2/1993 | Hammond et al. | 383/33 |
| 5,441,348 | 8/1995 | Valentino | 383/127 |
| 5,608,949 | 3/1997 | Cooley et al. | 24/30.5 R |
| 5,615,853 | 4/1997 | Hearst | 248/99 |

OTHER PUBLICATIONS

PCT Search Report Dated May 25, 1999.

*Primary Examiner*—Stephen P. Garbe
*Attorney, Agent, or Firm*—Michaele A. Hakamaki

[57] ABSTRACT

A gift package that comprises a bag having generally parallel front and rear walls, each having a top edge, a bottom edge, and two lateral edges, a pair of generally parallel side walls, each having a top edge, a bottom edge, and two lateral edges, wherein the lateral edges of the front and rear walls are joined to the lateral edges of the side panels, and a bottom panel having two pairs of generally parallel lateral edges, wherein the lateral edges of the bottom panel are joined to the bottom edges of the front, rear, and side walls to form a container having an opening defined by the top edges of the front, rear, and side walls, and wherein the bag has an expanded state and a collapsed state, where an area of the bag opening is larger when the bag is in its expanded state than when the bag is in its collapsed state. The gift bag further comprises a bag topper comprising a resilient member having a length and a width, wherein the resilient member has a relaxed state and a compressed state, wherein the bag topper in the compressed state is smaller in at least one of the length and width than when the bag topper is in the relaxed state, so that the bag topper urges the opening of the bag toward the expanded state of the bag as the bag topper moves from the compressed state of the bag topper to the relaxed state of the bag topper.

5 Claims, 3 Drawing Sheets

GIFT PACKAGE

TECHNICAL FIELD

The present invention relates to bag closures, in particular to a reusable bag closure adapted to conceal the contents of the bag.

BACKGROUND OF THE INVENTION

In recent years, there has been a tremendous growth in the manufacture and sale of containers, particularly decorative containers for receiving and holding objects, such as gift objects. One form of such containers is a decorative bag that is adapted to receive a gift item, which eliminates the need to place the items in separate boxes that are usually subsequently wrapped with gift wrapping paper. Instead, gift items may be "wrapped" in the bag and hidden from view using such items as tissue paper, confetti, bag stuffing, shredded ribbons, and the like. However, it is difficult to securely close such decorative bags if the user wishes to completely enclose the item in the bag. Several examples of bag closing methods include using decorative twist ties, tying bag handles together (if the bag has such handles), placing a fastenable bag closure on the bag (see, for example, U.S. Pat. Nos. 5,608,949 and 5,165,800), attaching a bow mechanism, such as that shown in U.S. Pat. No. 4,867,577, and stapling or taping the bag closed.

While these closures are useful, they often disadvantageously reduce the amount of usable space within the gift bag. One suggested solution to this problem was to provide inner structural support to give the bag the appearance of a box, and to provide a rectilinear lid to close the mouth of the bag. The handles of this bag extend through the slots in the lid, such as is shown in U.S. Pat. No. 4,930,903. Another alternative means for converting a gift bag into a "gift box" is to provide for overlapping flaps that can be folded into a configuration that gives a box-like appearance, such as that shown in U.S. Pat. No. 4,836,690.

SUMMARY OF THE INVENTION

In one aspect of this invention a gift package is provided comprising a bag having generally parallel front and rear walls, each having a top edge, a bottom edge opposite the top edge, and two lateral edges, a pair of generally parallel side walls, each having a top edge, a bottom edge opposite the top edge, and two lateral edges, wherein the lateral edges of the front and rear walls are joined to the lateral edges of the side panels, and a bottom panel having two pairs of generally parallel lateral edges, wherein the lateral edges of the bottom panel are joined to the bottom edges of the front, rear, and side walls to form a container having an opening defined by the top edges of the front, rear, and side walls, and wherein the bag has an expanded state and a collapsed state, where an area of the bag opening is larger when the bag is in its expanded state than when the bag is in its collapsed state. The gift bag further comprises a bag topper comprising a resilient member having a length and a width, wherein the resilient member has a relaxed state and a compressed state, wherein the bag topper in the compressed state is smaller in at least one of the length and width than when the bag topper is in the relaxed state, so that the bag topper urges the opening of the bag toward the expanded state of the bag as the bag topper moves from the compressed state of the bag topper to the relaxed state of the bag topper.

Optionally, the bag topper can be decorated with various configurations of gift ribbons, cut-out figures, balloons, and other decorative items. These items can be used to "address" the gift bag to the recipient, provide a greeting, identify the occasion for the gift bag, provide for visually stimulating decorations, and the like. Advantageously, the gift bags, particularly the closing mechanism provided by this invention, allow the user to utilize the full interior of the bag while being able to securely close the bag. Additionally, the resilient nature of the bag topper provides a means for holding the top of the gift bag open, as well as providing a frame for decorations.

A particularly unique feature of the present invention is that the bag topper uses and takes advantage of the interior cavity of the gift bag. This provides a mechanical advantage in that the confining dimensions of the gift bags serve to compress the bag topper sufficiently to effectively hold the bag topper in position without the necessity of additional attaching or adhering means.

The preformed gift bag topper of the present invention is convenient, simple to use, and minimizes the time required to decorate a gift bag. Furthermore, the preformed gift bag topper eliminates the potential frustration of forming tissue or other fillers into a pleasing decorative shape. The present invention allows all users, whether creatively inclined or not, to quickly and attractively "wrap" a gift. Additionally, the article of the present invention is configured in such a manner so that it may easily incorporate a wide variety of decorations.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
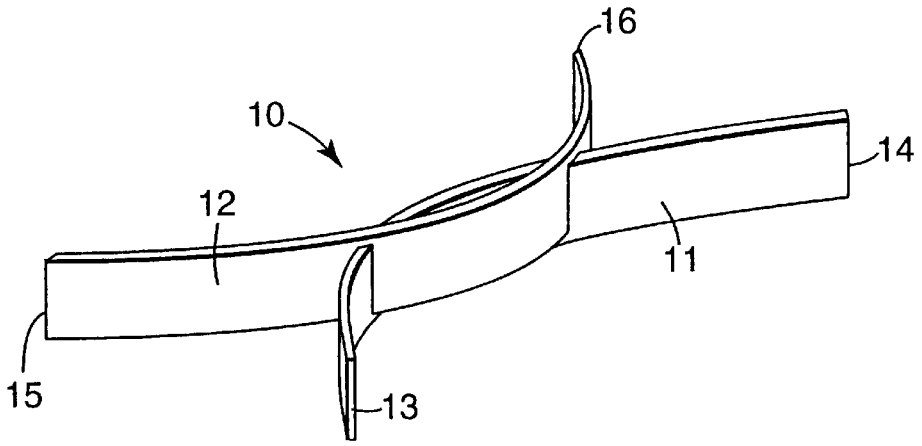
FIG. 1 is an isometric view of a bag topper of the present invention.
Figure 2:
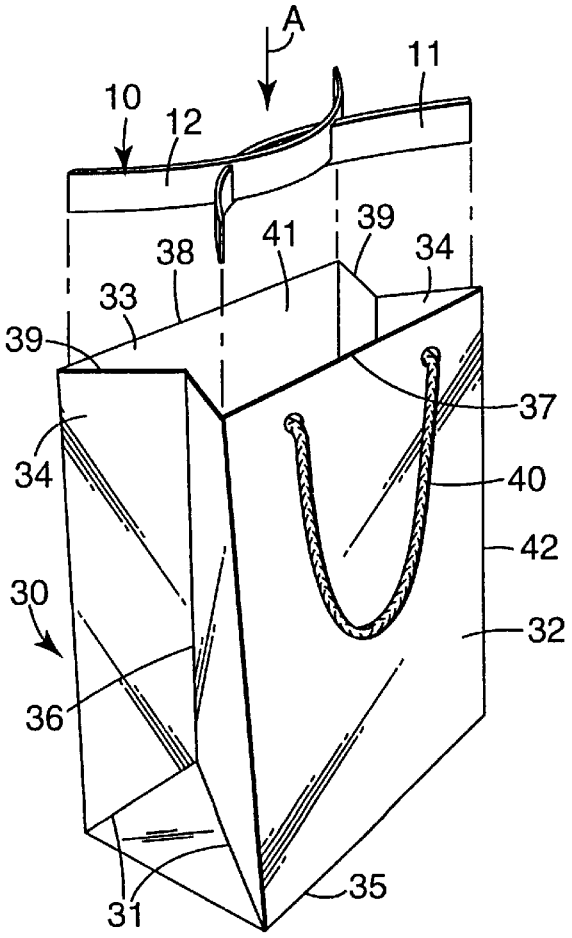
FIG. 2 is an isometric view of a gift bag and the bag topper of FIG. 1.
Figure 3:
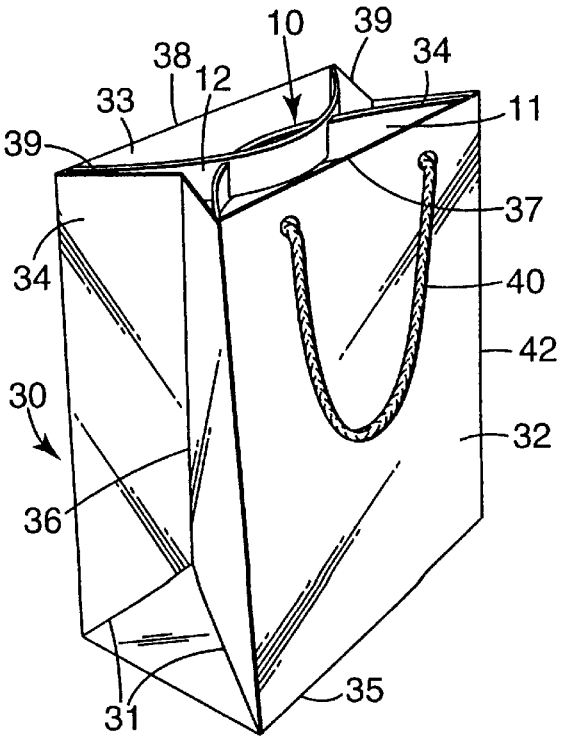
FIG. 3 is an isometric view of the gift bag and bag topper of FIGS. 1 and 2, wherein the bag topper is inserted into the gift bag.

Referring now to the Figures, wherein the components are labeled with like numerals throughout the several Figures, and initially to FIGS. 1, 2, and 3, one preferred embodiment of the gift package of the present invention is shown, generally comprising a bag 30 and a bag topper 10. The bag 30 is preferably fabricated from decorated paper, cardstock, or polymeric film, any of which may be coated or uncoated. The material is generally flexible, but possesses a degree of stiffness that is sufficient to provide a free-standing, upright bag. The bag 30 is conventional in design, including four longitudinal folds 42 dividing the bag 30 into generally parallel front and back walls or panels 32, 33 and two generally parallel side walls or panels 34. The parallel front and back panels 32, 33 each have an upper edge 37, 38, respectively. The bottom of the bag is folded in such a way as to provide for a flat bottom 35, which is preferably rectilinear in shape. The bag 30 as illustrated is in an open position providing an opening 41, through which access is gained to the interior of the bag 30. The parallel side panels 34 have central longitudinal creases or folds 36 and a pair of diagonal folds 31 extending from the crease or fold 36. The side panels also have upper edges 39, which extend between the upper edges 37, 38 of the front and back panels 32, 33. Further, the upper edges 37, 38, 39 of the bag are generally fabricated so that the edges 37, 38, 39 have a double material thickness.

The bag 30 is preferably further provided with a pair of handles 40, where one handle is connected to front panel 32 and the other handle 40 is connected to the back panel 33. The handles 40 may be of any suitable type and as illustrated may be a relatively flexible material, such as a ribbon, cording, or the like. The handles 40 may be attached and secured to the bag in any suitable fashion. Although the handles 40 are illustrated as lying on the outside surface of the front panel 32, the handles 40 may also be attached and secured to the front and back panels 32, 33 in such a manner as to allow the handles 40 to lie on the surface of the front and back panels 32, 33 on the inside of the bag 30. Alternatively, the handles may be relatively rigid and extend generally upwardly from the upper edge 37, 38 of the front and back panels 32, 33.

Bag 30 is shown in the Figures in its opened or expanded condition. In this opened condition, items may easily be placed and stored in the bag. However, when the bag is not in use, it may be folded along the longitudinal creases or folds 36 and diagonal folds 31 toward the center of the bag to collapse the bag into a collapsed or compact state. In this way, multiple bags may more easily be stored or shipped in a stack.

The bag topper 10 preferably comprises two interlocking elements 11, 12, wherein the element 11 has opposite ends 13, 14 and element 12 has opposite ends 15, 16. When the bag topper 10 is resting in its relaxed state, as shown in FIG. 1, the bag topper 10 has a length between ends 13 and 14 that is preferably the same as the length between the ends 15 and 16. The bag topper further has a width that is preferably the same between ends 13 and 15 as between ends 14 and 16. In accordance with the invention, the bag topper is designed to have an expanded or relaxed state where the topper is essentially in equilibrium, and a compressed state where the topper is smaller in at least one dimension than when the topper is in its relaxed state. Thus, the length or width of the bag topper 10 is preferably greater than the corresponding dimension of the opening 41 of the bag. To insert bag topper 10 into bag 30, the bag topper is compressed in the direction of the topper width or length. The bag topper 10 is then positioned within the opening 41 and released so that the topper 10 can move toward its expanded state. It is desirable that the topper will simultaneously urge the opening of the bag toward its expanded state, where the topper 10 also provides sufficient frictional engagement with the inside of the bag to keep the bag topper 10 in its desired position in the bag 30. While FIG. 1 illustrates a bag topper 10 as being two separate portions 11, 12 that are interlocked together, the bag topper 10 may instead be a single molded piece or may be otherwise constructed with multiple pieces in order to achieve the general configuration of the bag topper 10 shown in FIG. 1.

Alternatively, a portion of the elements 11, 12 could also include at least one adhering means that facilitates adherence of the bag topper 10 to the inside surface of the gift bag 30, as explained further below. This adhering means could be in the form of a patterned adhesive layer, a strip of adhesive, such as transfer adhesive, hook and loop, and the like. The adhering means can provide for permanent or reusable adhesion to the gift bag.

More particularly and as best shown in FIG. 2, in order to insert the bag topper 10 into a bag 30, the bag topper 10 is positioned over the opening 41 so that the ends 13, 14 are adjacent to the upper edge 37 of the front panel 32, and the ends 15, 16 are adjacent to the upper edge 38 of back panel 33. The bag topper 10 is then moved downward (as shown by an arrow A) so that the bag topper 10 is at least partially inserted into the opening 41 of the bag 30. The bag topper 10 may be inserted so that the entire bag topper is within the interior of the bag, or alternatively, the bag topper 10 may be only partially inserted into the opening 41. In either case, because either the height or width of the bag topper 10 is larger than the length or width of the bag 30 when it is in its relaxed state, when the bag topper 10 is compressed before insertion then released inside the opening 41 of the bag, the bag is urged toward an open position so that the bag topper 10 fits snugly into the opening of the bag 30 as shown in FIG. 3.

Several embodiments of the present invention are illustrated in FIGS. 4 through 8. While these embodiments represent various configurations these illustrations are not meant to limit the configurations of the bag topper of the present invention, provided the bag topper may be compressed and extended or expanded when it is inserted into the bag opening. Furthermore, any of the configurations may have additional elements and such additional elements may be used on the various configurations illustrated herein. For example, a portion of at least one element of the bag topper could be configured with an adhering means that facilitates adherence to the insider of the surface of a gift bag. This adhering means could be in the form of a patterned adhesive layer, a strip of adhesive, such as a transfer adhesive, hook and loop, and the like. This adhering means may provide for permanent or reusable adhesion to a gift bag.

Figure 4:
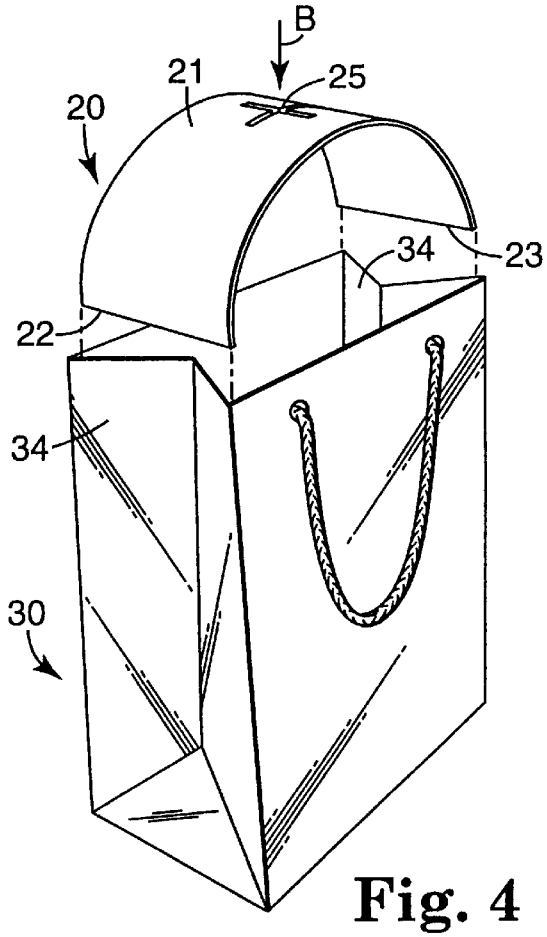
FIG. 4 is an isometric view of an alternative embodiment of the bag and bag topper of the present invention.

Referring now to FIG. 4, an alternative embodiment of a bag topper 20 is shown as it would be inserted into a bag 30. The bag topper 20 may be compressed and extended for use in a gift bag. The bag topper 20 generally comprises a body portion 21 having opposite ends 22, 23, wherein the bag topper 20 is made of a flexible and resilient material that may be compressed. In order to insert the bag topper 20 into the bag 30, the ends 22, 23 are compressed toward each other until the distance between ends 22, 23 is less than the length of the upper edge 37 of the front wall 32 (and upper edge 38 of rear wall 33). The bag topper 20 is then inserted at least partially into the gift bag 30 in the direction shown by arrow B. The bag topper 20 may then be released so that the ends 22, 23 move away from each other and toward the side panels 34 of the bag 30. As the topper 20 expands, the area of the body portion 21 adjacent the ends 22, 23 pushes against the side walls 34, thereby pushing the walls 34 away from each other. This tends to maximize the opening 41 of the gift bag 30. The ends 22, 23 are generally positioned in the interior of the bag 30 along side panels 34. Depending on the dimensions of the bag topper 20, the ends 22, 23 may be sufficiently long such that they contact the bottom 35 of the gift bag 30. The bag topper 20 may further comprise a slit or opening 25 for receiving a decorative element such as a bow, ribbon, fringes, or the like.

Figure 5:
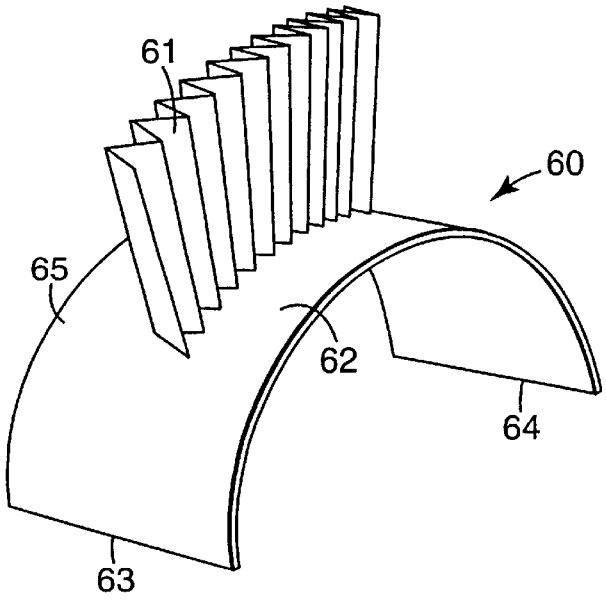
FIG. 5 is an isometric view of an alternative embodiment of the bag topper of the present invention having an additional decorative element.
Figure 6:
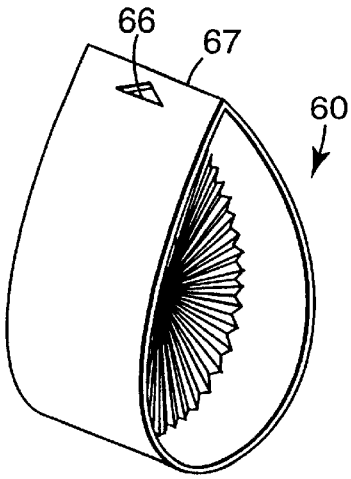
FIG. 6 is an isometric view of the bag topper of FIG. 5 where in the bag topper is configured for storage.

Another alternative embodiment of the bag topper of the present invention is illustrated in FIGS. 5 and 6 as a bag topper 60. This embodiment is similar to the bag topper 20 shown in FIG. 4, but the bag topper 60 is shown with a decorative element 61 attached to its top surface. The decorative element 61 may be a fringe, ribbon, bow, floral element, cut-out portion, or the like. The bag topper 60 may be inserted into a bag in the same manner as that described above with regard to FIG. 4. The bag topper 60 further comprises a body portion 62 having opposite ends 63, 64 and a top surface 65.

As shown in FIG. 6, the bag topper 60 can be folded toward itself so that the ends 63, 64 meet at intersection 67. This configuration is particularly useful for easy storage and may also provide a configuration that can be used for point of sale packaging. The ends 63, 64 may be temporarily adhered to each other for storage and may subsequently be separated from each other for insertion into a gift bag. This configuration may further comprise a cut-out portion 66 for use to hang the bag topper 60 in store displays, storage areas, and the like.

Figure 7:
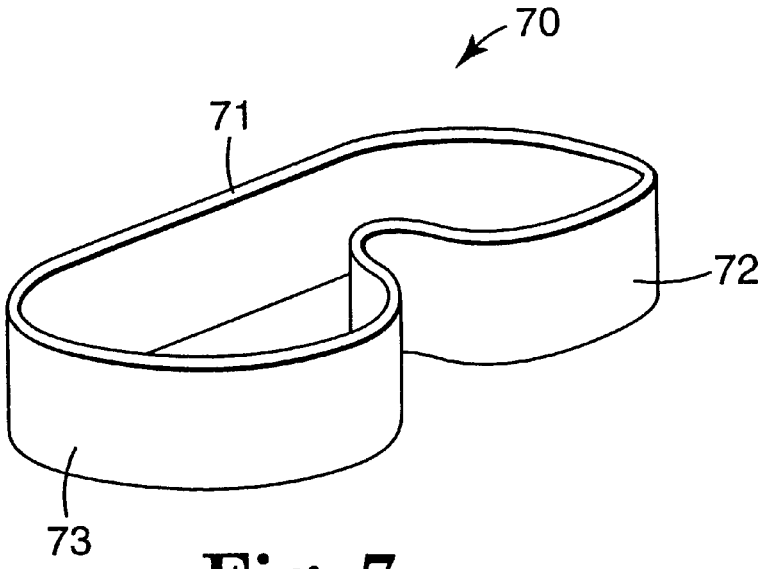
FIG. 7 is an isometric view of an alternative embodiment of the bag topper of the present invention.
Figure 8:
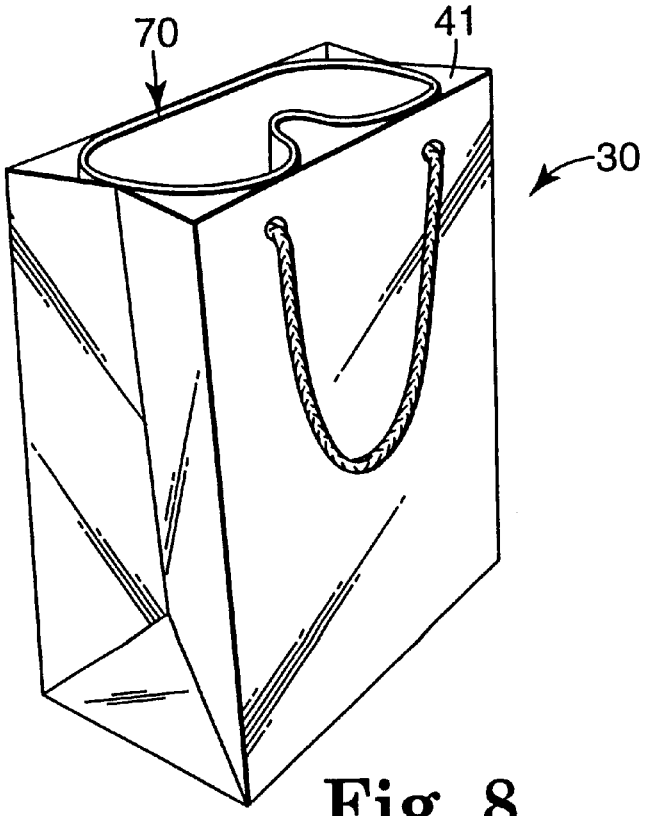
FIG. 8 is an isometric view of the gift bag and bag topper of FIG. 7, wherein the bag topper is inserted into the gift bag.

Another alternative embodiment of a bag topper is shown in FIGS. 7 and 8 as bag topper 70. The bag topper 70 comprises an enclosed annulus, wherein the annulus has a body portion 71 having two lobes 72, 73. As with the other embodiments of the bag toppers, the bag topper 70 is larger in at least one dimension than the opening 41 of the bag 30. In this way, the lobes 72, 73 may be compressed or pushed toward each other so that they are closer to one another and can thereby fit into the opening 41 in the bag 30. When the bag topper 70 is sufficiently inserted into the opening 41 of the bag 30, the bag topper 70 may be released so that the lobes 72, 73 may move back toward their relaxed positions as shown in FIG. 8. The particular shape of the annulus may be any of a wide variety of shapes, as long as it may be compressed for insertion into a bag opening.

The present invention has now been described with reference to several embodiments thereof The foregoing detailed description and examples have been given for clarity of understanding only. No unnecessary limitations are to be understood therefrom. It will be apparent to those skilled in the art that many changes can be made in the embodiments described without departing from the scope of the invention. For example, the bag toppers of the present invention may also be used with bags that do not have creases in their side panels. Thus, the scope of the present invention should not be limited to the structures described herein but only by the structures described by the language of the claims and the equivalence of those structures.

What is claimed is:

1. A gift package comprising:

a bag comprising generally parallel front and rear walls, each having a top edge, a bottom edge opposite the top edge, and two lateral edges, a pair of generally parallel side walls, each having a top edge, a bottom edge opposite the top edge, two lateral edges, and a generally longitudinal fold having a first end adjacent to the top edge of the side wall and a second end spaced from the first end, wherein the lateral edges of the front and rear walls are joined to the lateral edges of the side walls, and a bottom panel having two pairs of generally parallel lateral edges, wherein the lateral edges of the bottom panel are joined to the bottom edges of the front, rear, and side walls to form a container having an interior portion defined by the front, rear, and side walls and the bottom panel, the container further having an opening width defined as the distance between the top edges of the front and rear walls, wherein the bag has an expanded width and a collapsed width, where the width of the bag opening is smaller when the top edge of each side wall is at its collapsed width and more creased along the longitudinal fold than when each side wall is at its expanded width, and wherein the front, rear, and side walls possess a degree of stiffness that is sufficient to provide a free-standing, upright bag; and a bag topper comprising a resilient member having a length and a width, wherein the resilient member has a relaxed state and a compressed state, wherein the bag topper in the compressed state is smaller in length than when the bag topper is in the relaxed state, so that the bag topper contacts the side walls and urges the top edges of the side walls toward the expanded width as the bag topper moves from the compressed state of the bag topper to the relaxed state of the bag topper, and wherein the resilient member conceals the interior portion of the container.

2. The gift package of claim 1, wherein the bag topper further comprises at least one decorative element extending therefrom.

3. The gift package of claim 1, wherein the bag topper is formed as a single piece.

4. The gift package of claim 1, wherein the bag topper is made of material that is at least as rigid as the bag material.

5. A bag topper decorating a bag of the type comprising generally parallel front and rear walls, each having a top edge, a bottom edge opposite the top edge, and two lateral edges, a pair of generally parallel side walls, each having a top edge, a bottom edge opposite the top edge, two lateral edges, and a generally longitudinal fold having a first end adjacent to the top edge of the side wall and a second end spaced from the first end, wherein the lateral edges of the front and rear walls are joined to the lateral edges of the side walls, and a bottom panel having two pairs of generally parallel lateral edges, wherein the lateral edges of the bottom panel are joined to the bottom edges of the front, rear, and side walls to form a container having an interior portion defined by the front, rear, and side walls and the bottom panel, the container further comprising an opening width defined as the distance between the top edges of the front and rear walls, wherein the bag has an expanded width and a collapsed width, where the width of the bag opening is smaller when the top edge of each side wall is at its collapsed width and more creased along the longitudinal fold than when each side wall is at its expanded width, and wherein the front, rear, and side walls possess a degree of stiffness that is sufficient to provide a free-standing, upright bag, wherein the bag topper comprises:

a resilient member having a length and a width, wherein the resilient member has a relaxed state and a compressed state, wherein the bag topper in the compressed state is smaller in length than when the bag topper is in the relaxed state, so that the topper is adapted to contact the side walls and urge the top edges of the side walls toward the expanded width as the bag topper moves from the compressed state of the bag topper to the relaxed state of the bag topper, wherein the resilient member is adapted to conceal the interior portion of the container.

* * * * *